US009303965B1

(12) United States Patent
Dykstra

(10) Patent No.: US 9,303,965 B1
(45) Date of Patent: Apr. 5, 2016

(54) PRIMER INSTALLATION DEVICE

(71) Applicant: Greg Dykstra, Huron, SD (US)

(72) Inventor: Greg Dykstra, Huron, SD (US)

( * ) Notice: Subject to any disclaimer, the term of this patent is extended or adjusted under 35 U.S.C. 154(b) by 0 days.

(21) Appl. No.: 14/485,846

(22) Filed: Sep. 15, 2014

(51) Int. Cl.
*F42B 33/04* (2006.01)
*F42B 33/00* (2006.01)

(52) U.S. Cl.
CPC ..... *F42B 33/04* (2013.01); *F42B 33/001* (2013.01); *F42B 33/004* (2013.01)

(58) Field of Classification Search
CPC ..... F42B 33/001; F42B 33/004; F42B 33/04; F42B 5/36
USPC ..... 86/19.8, 32, 36
See application file for complete search history.

(56) References Cited

U.S. PATENT DOCUMENTS

| | | | | | |
|---|---|---|---|---|---|
| 774,827 | A | * | 11/1904 | Butler | 86/36 |
| 887,508 | A | * | 5/1908 | Olin | 86/32 |
| 1,502,824 | A | | 7/1924 | Louis | |
| 2,061,977 | A | | 11/1936 | Newcomb | |
| 2,775,157 | A | | 12/1956 | Hunt, Jr. | |
| 2,800,830 | A | * | 7/1957 | Gerstenberger | 86/23 |
| 2,807,186 | A | | 9/1957 | Veum | |
| 3,060,788 | A | * | 10/1962 | Blesi et al. | 86/27 |
| 3,128,668 | A | * | 4/1964 | Dicken | 86/45 |
| 3,152,508 | A | * | 10/1964 | Fratila | 86/38 |
| 3,157,086 | A | * | 11/1964 | Bachhuber | 86/27 |
| 3,205,762 | A | * | 9/1965 | Parke | 86/36 |
| 3,259,007 | A | * | 7/1966 | Havourd et al. | 86/36 |
| 3,320,848 | A | * | 5/1967 | Ponsness | 86/38 |
| 3,349,663 | A | | 10/1967 | Slee | |
| 3,555,959 | A | * | 1/1971 | Lee | 86/37 |
| 3,636,812 | A | | 1/1972 | Nuler | |
| 4,031,804 | A | * | 6/1977 | Boschi | 86/23 |
| 4,222,305 | A | * | 9/1980 | Lee | 86/37 |
| 4,228,724 | A | | 10/1980 | Leich | |
| 4,331,063 | A | | 5/1982 | Schaenzer | |
| 4,332,185 | A | | 6/1982 | Hargrove | |
| 4,375,778 | A | * | 3/1983 | Ryan | 86/36 |
| 4,393,744 | A | * | 7/1983 | Lee | 86/25 |
| 4,429,610 | A | * | 2/1984 | Mantel | 86/36 |
| 4,522,102 | A | * | 6/1985 | Pickens | 86/27 |
| 4,542,677 | A | * | 9/1985 | Lee | 86/38 |
| 4,590,841 | A | * | 5/1986 | Davis | 86/36 |
| 4,615,255 | A | * | 10/1986 | Carter | 86/27 |
| 5,025,706 | A | * | 6/1991 | Markle | 86/37 |
| 5,198,606 | A | * | 3/1993 | Storstad et al. | 86/32 |
| 5,435,223 | A | * | 7/1995 | Blodgett et al. | 86/38 |
| 5,693,905 | A | | 12/1997 | Blodgett | |
| 6,260,463 | B1 | | 7/2001 | Brand | |
| 7,806,034 | B1 | | 10/2010 | Lee | |

* cited by examiner

*Primary Examiner* — Bret Hayes

(57) ABSTRACT

A primer installation device provides consistent placement of a primer in an ammunition shell. The device includes a ram rod coupled to and positioned in a housing. An elevator is coupled to the housing. A position of the elevator is adjustable relative to the housing. The elevator is structured to comprise a conduit. A shell holder is coupled to the elevator. A loading pin is operationally coupled to the ram rod wherein operation of the ram rod extends the loading pin through the conduit in the elevator and through the shell holder such that the loading pin is configured for installing a primer into a shell positioned in the shell holder. Full extension of the loading pin is determined by physical obstruction of operation of the ram rod.

16 Claims, 7 Drawing Sheets

PRIMER INSTALLATION DEVICE

BACKGROUND OF THE DISCLOSURE

Field of the Disclosure

The disclosure relates to primer installation devices and more particularly pertains to a new primer installation device for providing consistent placement of a primer in an ammunition shell allowing a user to efficiently reload shells with each shell having a selectable, precise, and consistent primer position to enhance shooting precision.

SUMMARY OF THE DISCLOSURE

An embodiment of the disclosure meets the needs presented above by generally comprising a ram rod coupled to and positioned in a housing. An elevator is coupled to the housing. A position of the elevator is adjustable relative to the housing. The elevator is structured to comprise a conduit. A shell holder is coupled to the elevator. A loading pin is operationally coupled to the ram rod wherein operation of the ram rod extends the loading pin through the conduit in the elevator and through the shell holder such that the loading pin is configured for installing a primer into a shell positioned in the shell holder. Full extension of the loading pin is determined by physical obstruction of operation of the ram rod.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
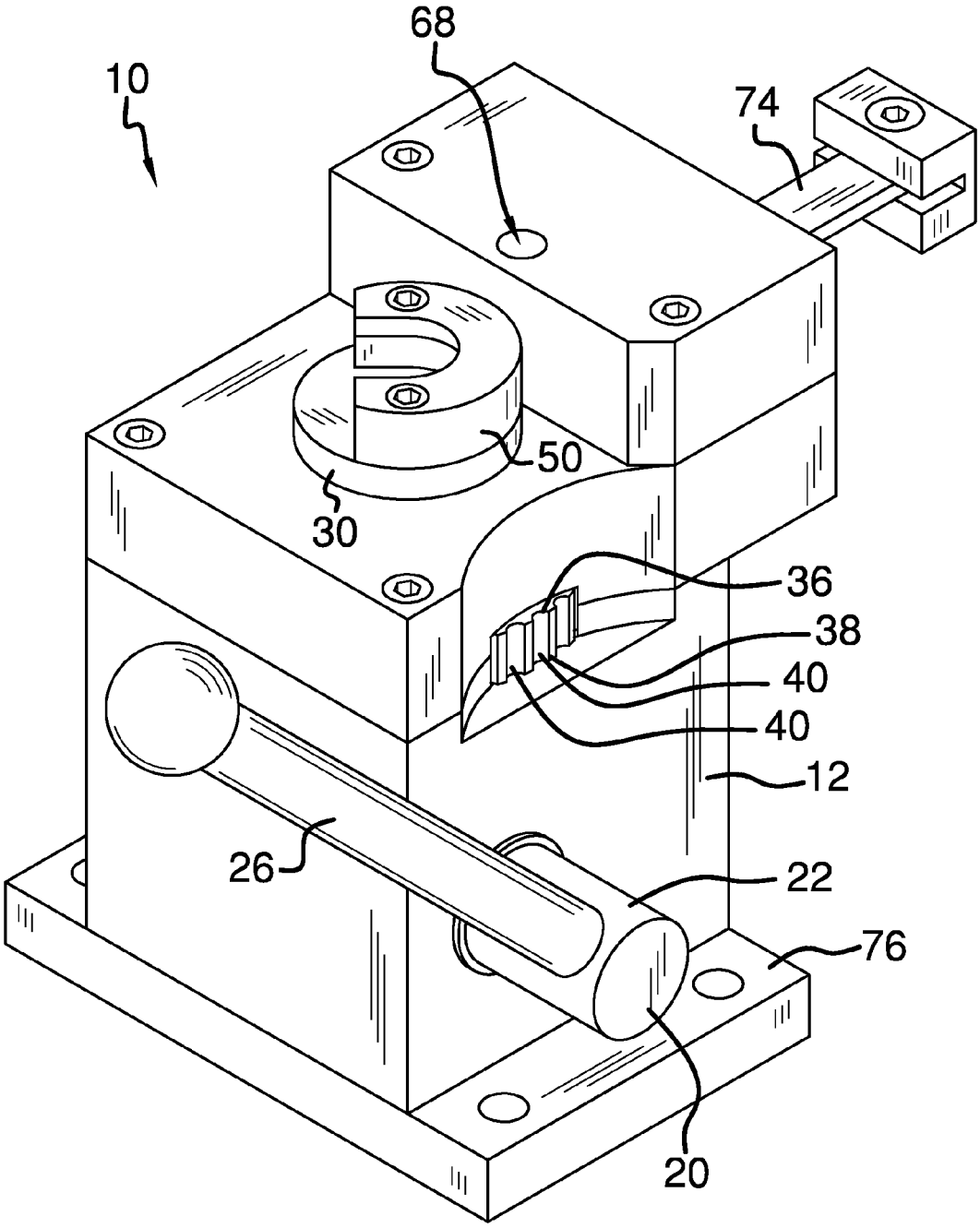
FIG. 1 is a top front side perspective view of a primer installation device according to an embodiment of the disclosure.
Figure 2:
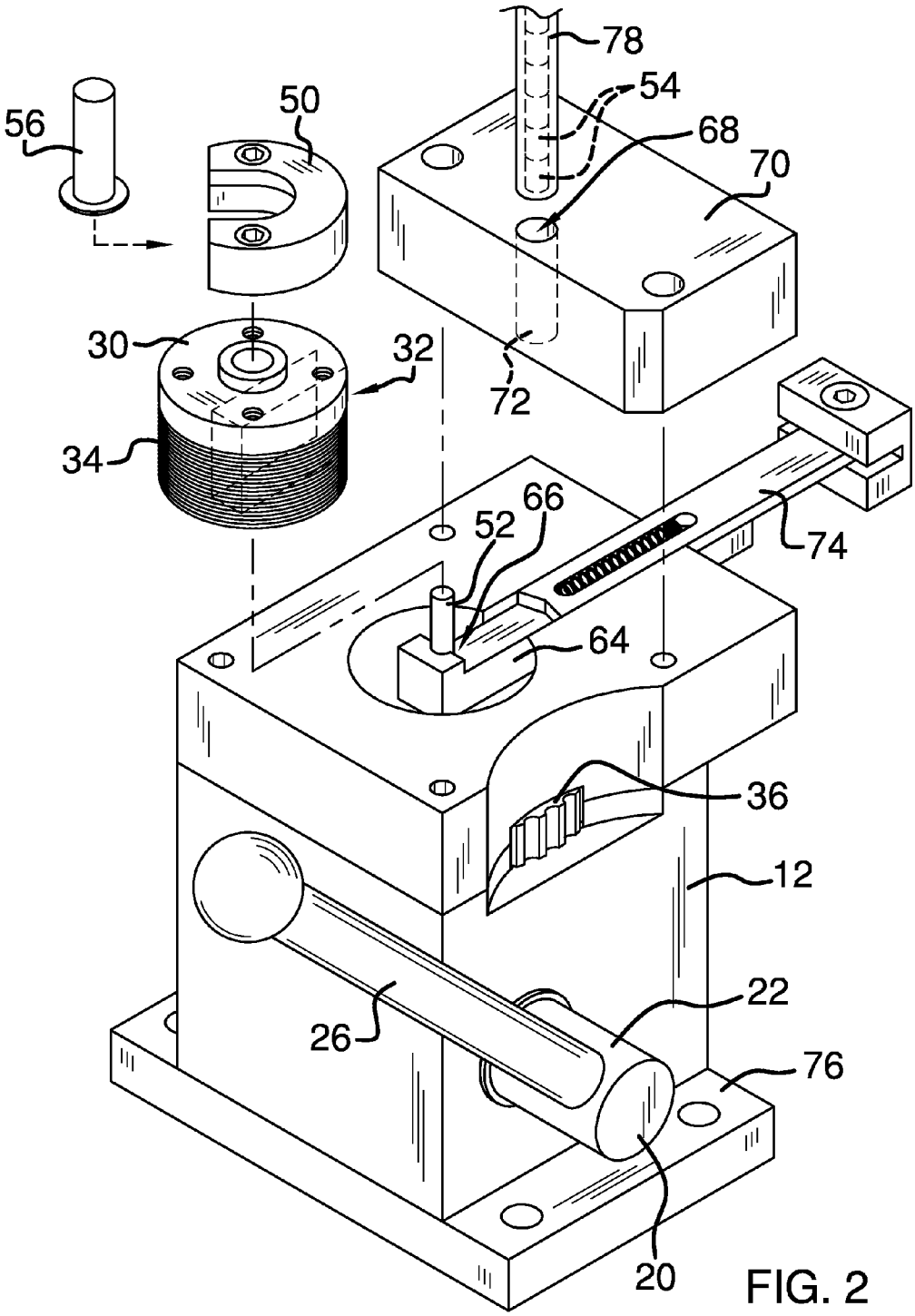
FIG. 2 is a partially exploded top front side perspective view of an embodiment of the disclosure.
Figure 3:
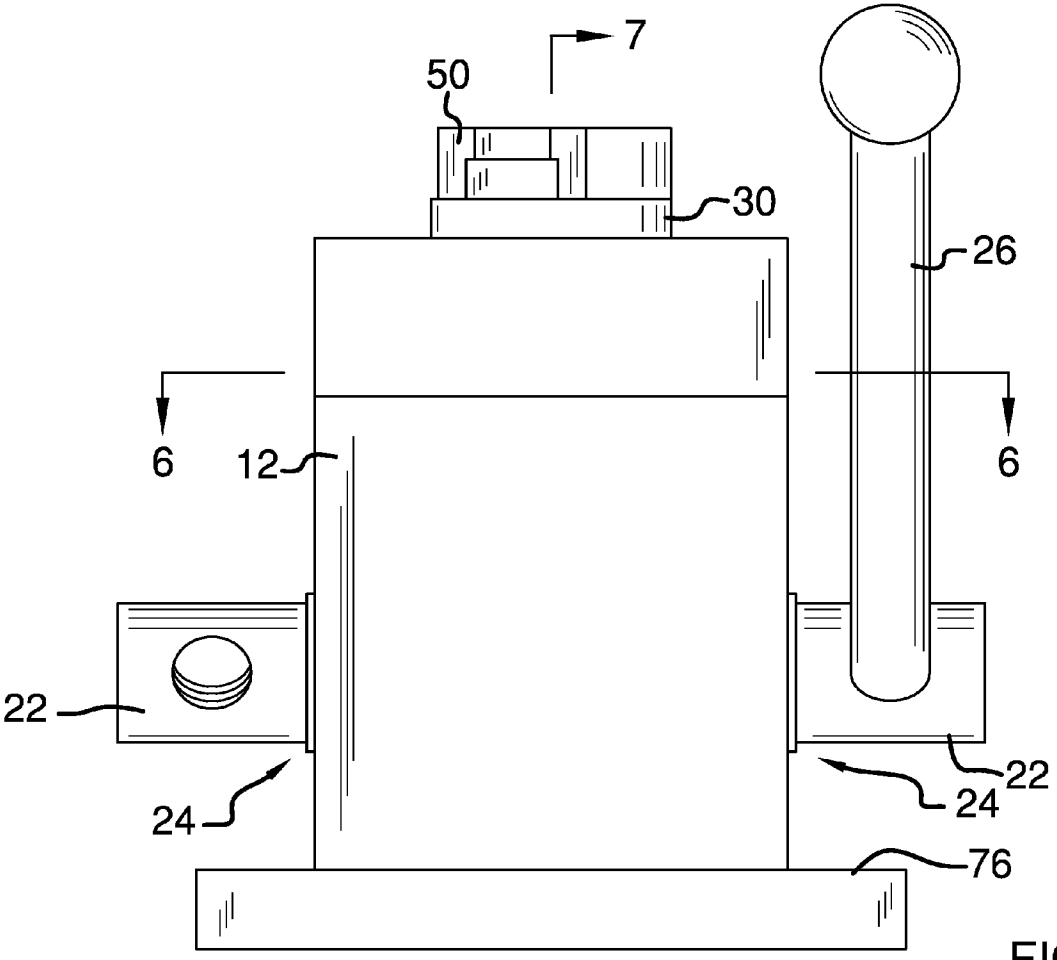
FIG. 3 is a front view of an embodiment of the disclosure.
Figure 4:
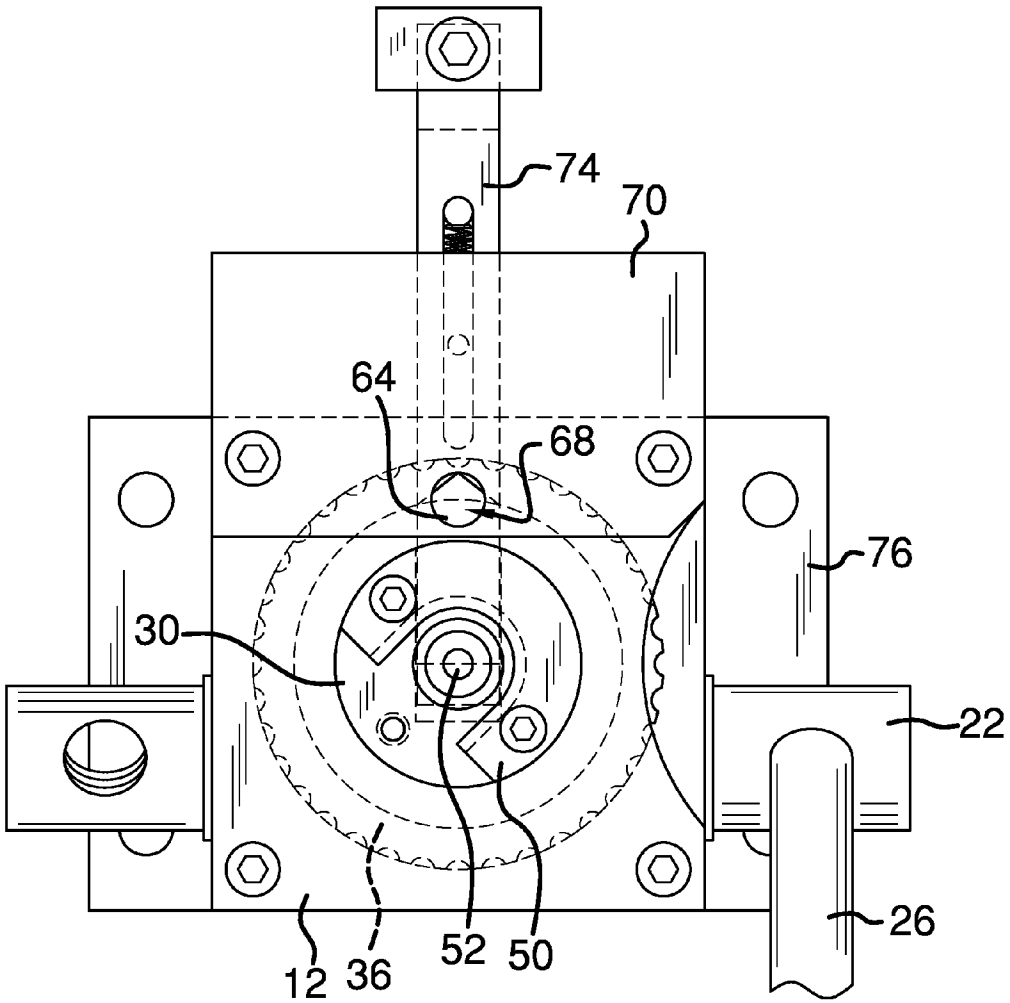
FIG. 4 is a top view of an embodiment of the disclosure.
Figure 5:
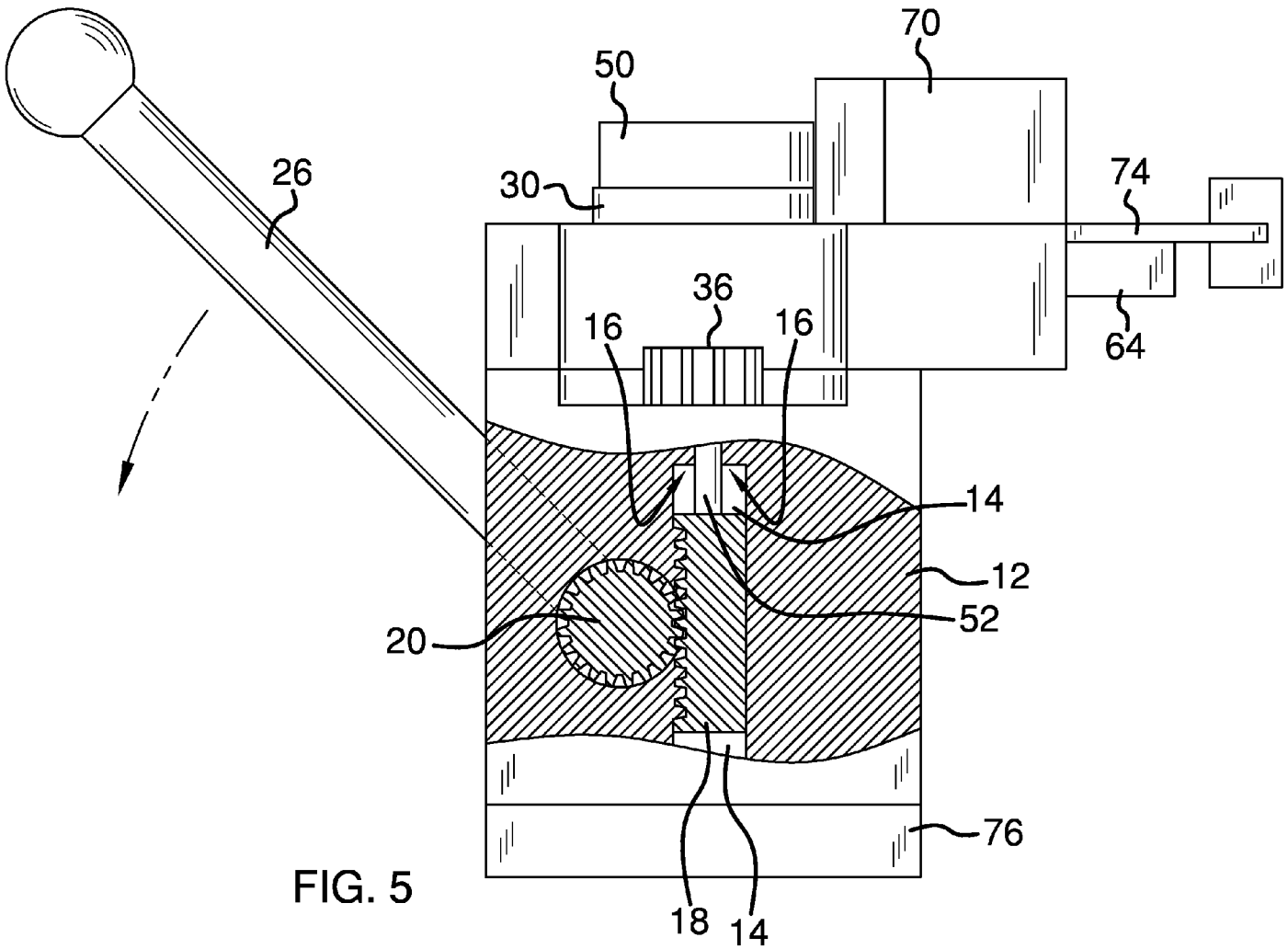
FIG. 5 is a partial cut away side view of an embodiment of the disclosure.
Figure 6:
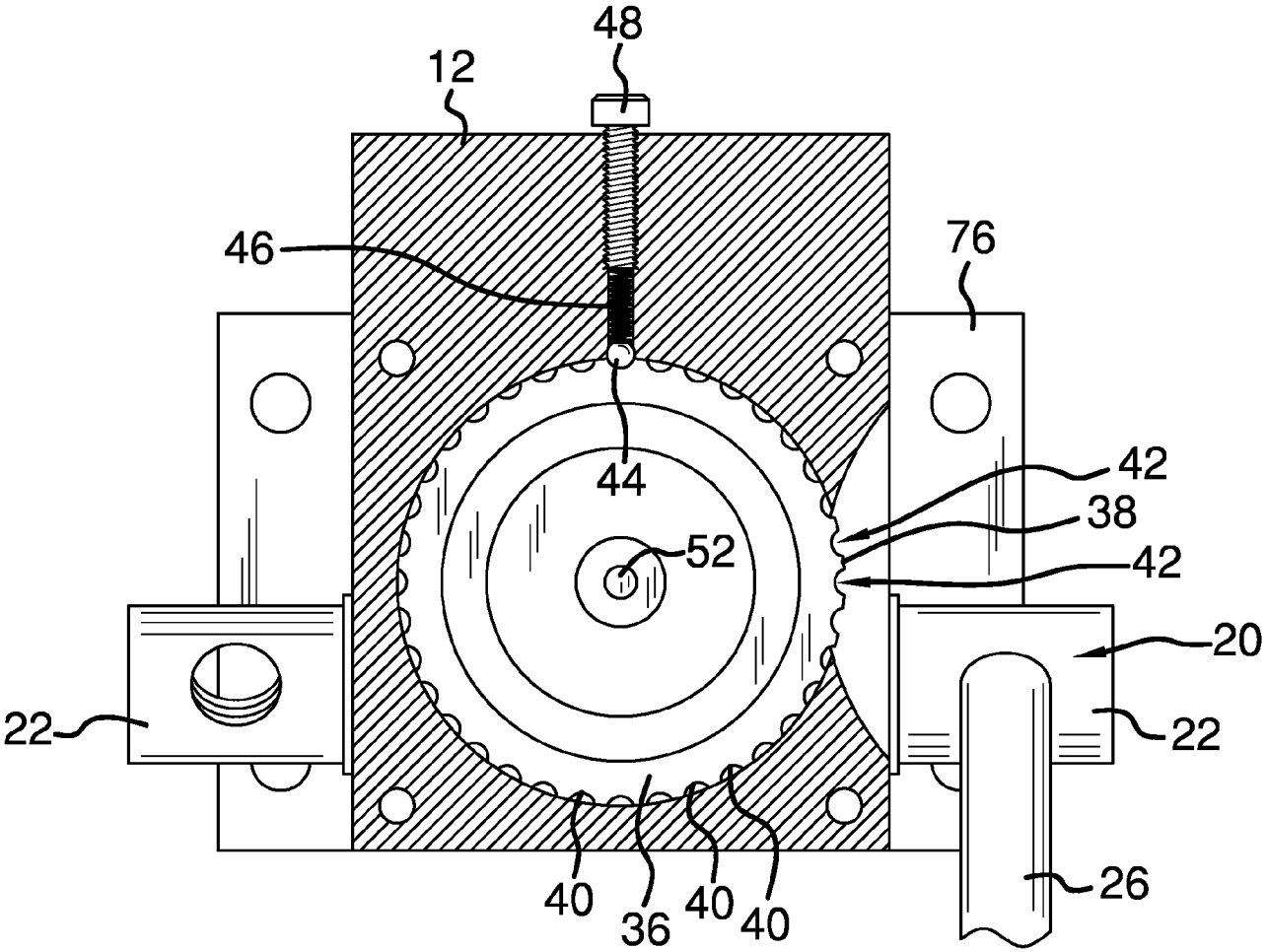
FIG. 6 is a cross-sectional view of an embodiment of the disclosure taken along line 6-6 of FIG. 3.
Figure 7:
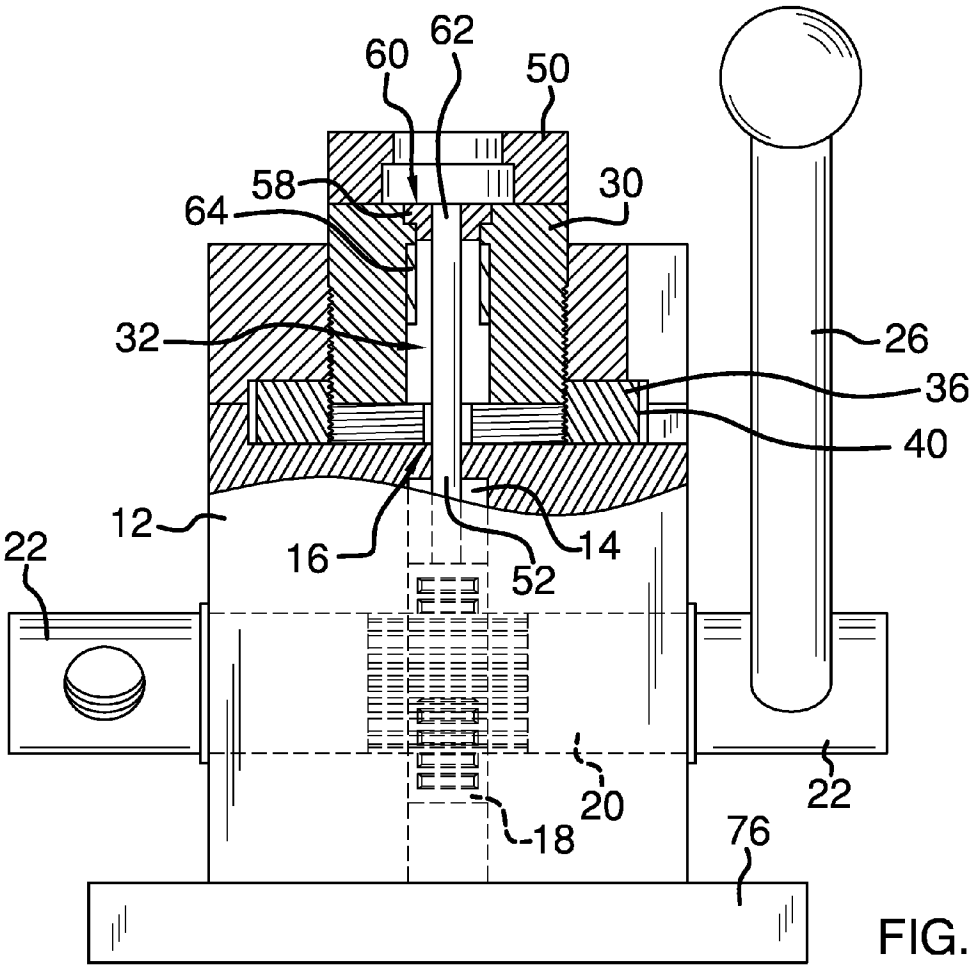
FIG. 7 is a partial cut-away front view of an embodiment of the disclosure.

With reference now to the drawings, and in particular to FIGS. 1 through 7 thereof, a new primer installation device embodying the principles and concepts of an embodiment of the disclosure and generally designated by the reference numeral 10 will be described.

As best illustrated in FIGS. 1 through 7, the primer installation device 10 generally comprises a housing 12 defining a ram chamber 14 having an upper lip 16. A ram rod 18 is coupled to the housing 12 by being positioned in the ram chamber 14. The ram rod 18 abuts the upper lip 16 when the ram rod 18 is fully elevated within the ram chamber 14. A ram rotor 20 is coupled to the housing 12. The ram rotor 20 engages the ram rod 18 defining a rack and pinion mechanism such that rotation of the ram rotor 20 elevates the ram rod 18 within the ram chamber 14. The housing 12 may be attached to a base plate 76 configured for coupling to a support structure.

The ram rotor 20 has a pair of end sections 22. Each of the end sections 22 of the ram rotor 20 extends from a respective side 24 of the housing 12. A handle 26 is coupled to the ram rotor 20 such that manipulation of the handle 26 rotates the ram rotor 20. The handle 26 is removably coupled to a selectable one of the end sections 22 of the ram rotor 20 allowing the handle 26 to be positioned on either side 24 of the housing 12 to accommodate use of the handle 26 by the right hand or left hand of a user. The handle 26 is attached to the ram rotor 20 using threading or another conventional removable connection.

An elevator 30 is coupled to the housing 12 in vertical alignment with the ram chamber 14. A position of the elevator 30 is adjustable relative to the housing 12 as described in more detail below. A slot 32 extends into the elevator 30. The elevator 30 has a threaded portion 34. A wheel 36 has a threaded surface 38 complementary to and engaging the threaded portion 34 of the elevator 30. The wheel 36 is coupled to the housing 12 such that the wheel 36 is rotatable within a fixed position in the housing 12. The slot 32 in the elevator 30 is generally engaged to prevent rotation of the elevator 30 within the housing 12. Thus, rotation of the wheel 36 moves the elevator up and down in the housing 12 and adjusts a position of the elevator 30 relative to the upper lip 16.

An outer surface 38 of the wheel 36 is structured to comprise a plurality of detents 40. The detents 40 are evenly spaced around the outer surface 38 of the wheel 36 wherein the detents 40 define a plurality of incremental stops 42 around the wheel 36. Spacing of the detents 40 is correlated to correspond to the threaded portion 34 of the elevator 30 such that rotation of the wheel 36 between adjacent stops 42 moves the elevator 30 a distance between 0.5 and 2.0 thousandths of a inch relative to the upper lip 16. A ball bearing 44 is positioned in the housing 12 and positioned to engage each detent 40 as the wheel 36 is rotated such that engagement of the ball bearing 44 to each detent 40 provides resistance to rotation of the wheel 36. A biasing member 46 is coupled to the housing 12 urging the ball bearing 44 into contact with the outer surface 38 of the wheel 36. A screw 48 is coupled to the housing 12. The biasing member 46 is positioned between the screw 48 and the ball bearing 44 such that manipulation of the screw 48 selectively compresses and decompresses the biasing member 46 between the ball bearing 44 and the screw 48. Thus, pressure exerted on the wheel 36 by the ball bearing 44 is adjustable by manipulation of the screw 48. Sufficient tightening of the screw 48 provides for resistance to prevent rotation of the wheel 36 relative to the housing 12, fixing the position of the elevator 30 relative to the upper lip 16.

A shell holder 50 of conventional design is coupled to the elevator 30 such that the shell holder 50 is held in a fixed position relative to the elevator 30 as the ram rod 18 is actuated. A loading pin 52 rests on the ram rod 18 such that the loading pin 52 is operationally coupled to the ram rod 18. Operation of the ram rod 18 extends the loading pin 52 through the elevator 30 and the shell holder 50 such that the loading pin 52 is configured for installing a primer 54 into a shell 56 positioned in the shell holder 50. Full extension of the loading pin 52 is determined by physical obstruction of operation of the ram rod 18 within the ram chamber 14 providing precise repeatable positioning of the loading pin 52, and thus the primer 54, relative to the shell 56 in the shell holder 50. A bushing 58 is positioned in a conduit 60 extending through the elevator 30. The loading pin 52 extends through the conduit 60 such that the bushing 58 centers the loading pin 52 within the conduit 60.

The loading pin 52 may be one of a plurality of loading pins 52 with each loading pin 52 having a unique diameter transverse to a longitudinal axis of the loading pin 52 corresponding to loading of primers 54 corresponding to various sizes of shells 56. The bushing 58 is one of a plurality of bushings 58. A size of a central opening 62 of each bushing 58 corresponds to a respective one of the loading pins 52.

A shuttle bed 64 is coupled to and extends through the housing 12. The shuttle bed 64 defines a seat 66 aligned with the loading pin 52. The seat 66 is configured for receiving the primer 54 such that the primer 54 is aligned with the loading pin 52. The loading pin 52 is extended through the shuttle bed 64 when the ram rod 18 is extended. Thus, the loading pin 52 is configured to urge the primer 54 positioned in the seat 66 into the shell 56 positioned in the shell holder 50. The shuttle bed 64 extends through the housing 12 and into the slot 32 in the elevator 30 wherein the shuttle bed 64 prevents rotation of the elevator 30 within the housing 12. The shuttle bed 64 may also be one of a plurality of shuttle beds 64 interchangeably couplable to the housing 12 with each shuttle bed 64 being configured to correspond to a respective one of the loading pins 52 for a particular size of shell 56. A chute 68 is coupled to the housing 12. The chute 68 may be incorporated into a block 70 coupled to the housing 12. The chute 68 has a dispensing opening 72 aligned with the shuttle bed 64 wherein the chute 68 is configured for delivering the primer 54 to the shuttle bed 64 spaced from the seat 66. A slide 74 is coupled to the shuttle bed 64. The slide 74 is movable along the shuttle bed 64 such that the slide 74 is configured to move the primer 54 along the shuttle bed 64 to the seat 66. The slide 74 may be biased such that the slide 74 is urged away from the seat 66 until manipulated. The chute 68 is transversely oriented relative to the shuttle bed 64 wherein the chute 68 is configured to receive a tube 78 of vertically stacked primers 54 such that the primers 54 are sequentially dispensed onto the shuttle bed 64 with each manipulation of the slide 74.

In use, the device 10 is assembled using the desired size of loading pin 52, shuttle bed 64, bushing 58, shell holder 50, and other components which may correspond to a particular size of ammunition. The wheel 36 is rotated to a desired position corresponding to a precise positioning of the shell holder 50 relative to the upper lip 16 within the housing 12. A shell 56 is engaged to the shell holder 50 and a primer 54 is positioned in the seat 66 by manipulation of the slide 74. The handle 26 is manipulated to move the ram rod 18 until the ram rod 18 abuts the upper lip 16. The primer 54 is driven into the shell 56 until the ram rod 18 against the upper lip 16. The shell 56 is now primed and removed from the shell holder 50. A new shell 56 is loaded and the process repeated with each primer 54 being driven to a precise, adjustable, consistent position in the respective shell 56.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A primer installation device comprising:

a housing, said housing defining a ram chamber having an upper lip;

a ram rod coupled to and positioned in said housing, said ram rod abutting said upper lip when said ram rod is fully elevated within said ram chamber;

an elevator coupled to said housing, said elevator having a threaded portion, a position of said elevator being adjustable relative to said housing, said elevator being structured to comprise a conduit;

a wheel having a threaded surface, said threaded surface being complementary to and engaging said threaded portion of said elevator, said wheel being coupled to said housing such that said wheel is rotatable within a fixed position in said housing whereby rotation of said wheel adjusts a position of said elevator relative to said upper lip;

a shell holder coupled to said elevator;

a loading pin operationally coupled to said ram rod wherein operation of said ram rod extends said loading pin through said conduit in said elevator and through said shell holder such that said loading pin is configured for installing a primer into a shell positioned in said shell holder; and wherein full extension of said loading pin is determined by physical obstruction of operation of said ram rod.

2. The device of claim 1, further comprising a ram rotor coupled to said housing, said ram rotor engaging said ram rod such that rotation of said ram rotor elevates said ram rod within said ram chamber.

3. The device of claim 2, further comprising a handle coupled to said ram rotor such that manipulation of said handle rotates said ram rotor.

4. The device of claim 3, further comprising said ram rotor having a pair of end sections, each of said end sections of said ram rotor extending from a respective side of said housing, said handle being removably coupled to a selectable one of said end sections of said ram rotor.

5. The device of claim 1, further comprising:

an outer surface of said wheel being structured to comprise a plurality of detents; and a ball bearing positioned in said housing, said ball bearing being positioned to engage each said detent as said wheel is rotated such that engagement of said ball bearing to each said detent provides resistance to rotation of said wheel.

6. The device of claim 5, further comprising:

a biasing member coupled to said housing, said biasing member urging said ball bearing into contact with said outer surface of said wheel; and a screw coupled to said housing, said biasing member being positioned between said screw and said ball bearing such that manipulation of said screw selectively compresses and decompresses said biasing member between said ball bearing and said screw wherein pressure exerted on said wheel by said ball bearing is adjustable by manipulation of said screw.

7. The device of claim 5, further comprising said detents being evenly spaced around said outer surface of said wheel wherein said detents define a plurality of incremental stops around said wheel.

8. The device of claim 7, further comprising spacing of said detents corresponding to said threaded portion of said elevator such that rotation of said wheel between adjacent stops moves said elevator a distance between 0.5 and 2.0 thousandths of a inch relative to said upper lip.

9. The device of claim 1, further comprising a bushing positioned in said conduit, said loading pin extending through said conduit such that said bushing centers said loading pin within said conduit.

10. The device of claim 9, further comprising:

said loading pin being one of a plurality of loading pins, each said loading pin having a unique diameter transverse to a longitudinal axis of said loading pin; and said bushing being one of a plurality of bushings, a size of a central opening of each said bushing corresponding to a respective one of said loading pins.

11. The device of claim 1, further comprising a shuttle bed coupled to and extending through said housing, said shuttle bed defining a seat aligned with said loading pin, said seat being configured for receiving the primer such that the primer is aligned with said loading pin, said loading pin being extended through said shuttle bed when said ram rod is extended wherein said loading pin is configured to urge the primer into the shell positioned in said shell holder.

12. The device of claim 1, further comprising:

a ram rotor coupled to said housing, said ram rotor engaging said ram rod such that rotation of said ram rotor elevates said ram rod within said ram chamber, said ram rotor having a pair of end sections, each of said end sections of said ram rotor extending from a respective side of said housing;

a handle coupled to said ram rotor such that manipulation of said handle rotates said ram rotor, said handle being removably coupled to a selectable one of said end sections of said ram rotor;

an outer surface of said wheel being structured to comprise a plurality of detents, said detents being evenly spaced around said outer surface of said wheel wherein said detents define a plurality of incremental stops around said wheel, spacing of said detents corresponding to said threaded portion of said elevator such that rotation of said wheel between adjacent stops moves said elevator a distance between 0.5 and 2.0 thousandths of a inch relative to said upper lip;

a ball bearing positioned in said housing, said ball bearing being positioned to engage each said detent as said wheel is rotated such that engagement of said ball bearing to each said detent provides resistance to rotation of said wheel;

a biasing member coupled to said housing, said biasing member urging said ball bearing into contact with said outer surface of said wheel;

a screw coupled to said housing, said biasing member being positioned between said screw and said ball bearing such that manipulation of said screw selectively compresses and decompresses said biasing member between said ball bearing and said screw wherein pressure exerted on said wheel by said ball bearing is adjustable by manipulation of said screw;

said loading pin being one of a plurality of loading pins, each said loading pin having a unique diameter transverse to a longitudinal axis of said loading pin;

a bushing positioned in said conduit, said loading pin extending through said conduit such that said bushing centers said loading pin within said conduit, said bushing being one of a plurality of bushings, a size of a central opening of each said bushing corresponding to a respective one of said loading pins;

a shuttle bed coupled to and extending through said housing, said shuttle bed defining a seat aligned with said loading pin, said seat being configured for receiving the primer such that the primer is aligned with said loading pin, said loading pin being extended through said shuttle bed when said ram rod is extended wherein said loading pin is configured to urge the primer into the shell positioned in said shell holder, said shuttle bed extending through said housing and into said slot in said elevator wherein said shuttle bed prevents rotation of said elevator within said housing, said shuttle bed being one of a plurality of shuttle beds interchangeably couplable to said housing, each said shuttle bed being configured to correspond to a respective one of said loading pins;

a chute coupled to said housing, said chute having a dispensing opening aligned with said shuttle bed wherein said chute is configured for delivering a primer to said shuttle bed; and a slide coupled to said shuttle bed, said slide being movable along said shuttle bed such that said slide is configured to move the primer along said shuttle bed to said seat, said slide being biased such that said slide is urged away from said seat until manipulated, said chute being transversely oriented relative to said shuttle bed wherein said chute is configured to receive a tube of vertically stacked primers such that the primers are sequentially dispensed onto said shuttle bed upon manipulation of said slide.

13. A primer installation device comprising:

a housing;

a ram rod coupled to and positioned in said housing;

an elevator coupled to said housing, a position of said elevator being adjustable relative to said housing, said elevator being structured to comprise a conduit;

a shell holder coupled to said elevator;

a loading pin operationally coupled to said ram rod wherein operation of said ram rod extends said loading pin through said conduit in said elevator and through said shell holder such that said loading pin is configured for installing a primer into a shell positioned in said shell holder;

wherein full extension of said loading pin is determined by physical obstruction of operation of said ram rod;

a shuttle bed coupled to and extending through said housing, said shuttle bed defining a seat aligned with said loading pin, said seat being configured for receiving the primer such that the primer is aligned with said loading pin, said loading pin being extended through said shuttle bed when said ram rod is extended wherein said loading pin is configured to urge the primer into the shell positioned in said shell holder;

a slot extending into said elevator; and said shuttle bed extending through said housing and into said slot in said elevator wherein said shuttle bed prevents rotation of said elevator within said housing.

14. A primer installation device comprising:

a housing;

a ram rod coupled to and positioned in said housing;

an elevator coupled to said housing, a position of said elevator being adjustable relative to said housing, said elevator being structured to comprise a conduit;

a shell holder coupled to said elevator;

a loading pin operationally coupled to said ram rod wherein operation of said ram rod extends said loading pin through said conduit in said elevator and through said shell holder such that said loading pin is configured for installing a primer into a shell positioned in said shell holder;

wherein full extension of said loading pin is determined by physical obstruction of operation of said ram rod;

a shuttle bed coupled to and extending through said housing, said shuttle bed defining a seat aligned with said loading pin, said seat being configured for receiving the primer such that the primer is aligned with said loading pin, said loading pin being extended through said shuttle bed when said ram rod is extended wherein said loading pin is configured to urge the primer into the shell positioned in said shell holder;

a chute coupled to said housing, said chute having a dispensing opening aligned with said shuttle bed wherein said chute is configured for delivering a primer to said shuttle bed; and a slide coupled to said shuttle bed, said slide being movable along said shuttle bed such that said slide is configured to move the primer along said shuttle bed to said seat.

15. The device of claim 14, further comprising said slide being biased such that said slide is urged away from said seat until manipulated.

16. The device of claim 14, further comprising said chute being transversely oriented relative to said shuttle bed wherein said chute is configured to receive a tube of vertically stacked primers such that the primers are sequentially dispensed onto said shuttle bed upon manipulation of said slide.

* * * * *